US008373534B2

(12) United States Patent
Kawarai

(10) Patent No.: US 8,373,534 B2
(45) Date of Patent: Feb. 12, 2013

(54) FLEXIBLE COIL

(75) Inventor: Mitsugu Kawarai, Tokyo (JP)

(73) Assignee: Sumida Corporation (JP)

( * ) Notice: Subject to any disclaimer, the term of this patent is extended or adjusted under 35 U.S.C. 154(b) by 138 days.

(21) Appl. No.: 12/096,587

(22) PCT Filed: Oct. 5, 2006

(86) PCT No.: PCT/JP2006/319988

§ 371 (c)(1),
(2), (4) Date: Jun. 6, 2008

(87) PCT Pub. No.: WO2007/066449

PCT Pub. Date: Jun. 14, 2007

(65) Prior Publication Data

US 2010/0001823 A1 Jan. 7, 2010

(30) Foreign Application Priority Data

Dec. 7, 2005 (JP) ..... 2005-353145

(51) Int. Cl.
*H01F 5/00* (2006.01)
*H01F 27/28* (2006.01)
*H01F 7/06* (2006.01)

(52) U.S. Cl. ..... 336/200; 336/223; 336/232; 29/602.1

(58) Field of Classification Search ..... 336/200, 336/223, 232; 29/602.1
See application file for complete search history.

(56) References Cited

U.S. PATENT DOCUMENTS

| | | | |
|---|---|---|---|
| 4,959,631 | A | 9/1990 | Hasegawa et al. |
| 2002/0167783 | A1 | 11/2002 | Waffenschmidt et al. |

FOREIGN PATENT DOCUMENTS

| | | | |
|---|---|---|---|
| CN | 1207565 | A | 2/1999 |
| CN | 1392756 | A | 1/2003 |
| DE | 19639881 | | 4/1998 |
| EP | 1257156 | | 11/2002 |
| JP | 57-134813 | | 8/1982 |
| JP | 01-318212 | | 12/1989 |
| JP | 19913709 | | 1/1991 |
| JP | 10-275725 | | 10/1998 |
| JP | 2000-091135 | | 3/2000 |
| JP | 2001-250722 | | 9/2001 |
| JP | 2005-303142 | | 10/2005 |
| JP | 2006-210541 | | 8/2006 |
| WO | WO 03/096361 | | 11/2003 |
| WO | WO 2005/02054 | | 3/2005 |

*Primary Examiner* — Mohamad Musleh
*Assistant Examiner* — Ronald Hinson
(74) *Attorney, Agent, or Firm* — Stephen Chin

(57) ABSTRACT

The present invention is to provide a coil having flexibility even if it includes a core body. A flexible coil 10 comprises a plurality of sheet-like coils laminated together in a region sharing a magnetic flux, wherein each sheet-like coil has a coil section formed along a surface of an insulating sheet having flexibility; and magnetic bodies 80 and 81 that have flexibility and sandwich the plurality of the laminated sheet-like coils.

8 Claims, 12 Drawing Sheets

FLEXIBLE COIL

CROSS REFERENCES TO RELATED APPLICATIONS

This application claims priority to international application number PCT/JP 2006/319988 filed on Oct. 5, 2006 which claims priority to Japanese patent application bearing application number JP2005-353145 filed on Dec. 7, 2005, the entire disclosures of which are hereby incorporated by reference.

TECHNICAL FIELD

The present invention relates to a flexible coil.

BACKGROUND OF THE INVENTION

Conventionally, a core body such as an inductor includes a ferrite sintered body or a body molded and pressed with metal powders. Further, an inductor having a hoop and the like used as an electrode is hardly deformed since rigidity of a core body is large. However, the inductor has weakness in bending, a shock of a dropping test and the like. Further, when the conventional inductor having large rigidity is mounted on a flexible substrate, it is possible to mount the inductor if the size of the inductor is small, but it is not possible to mount the inductor if the size is large since the inductor can't follow bending of a flexible substrate. As an inductor for overcoming such issue, an inductor disclosed in the patent document 1 is known for example.

[Patent Document 1]

Japanese Patent Application Laid-Open No. 2000-91135 (Refer to FIG. 1 to FIG. 3)

DISCLOSURE OF THE INVENTION

The inductor disclosed in the patent document 1 comprises an inductor portion composed of a winding conductor integrally made of a thin copper plate and an insulating resin sheet having flexibility that is attached to both sides of the inductor portion. The inductor disclosed in the patent document 1 has flexibility since the inductor portion and the resin sheet have flexibility.

The inductor disclosed in the patent document 1 has above-referenced structure, but does not include a magnetic material. Hence, the inductor is an air core coil type one which an inductance is small. In order to gain high inductance, it needs that a core body which has large rigidity and is made of a ferrite sintered body or a body pressed and molded with metal powders is provided within a coil. Accordingly, there is a disadvantage in that rigidity of an inductor becomes large as the above result.

In order to overcome the above disadvantage, the present invention provides a coil having flexibility even if it comprises a core body.

MEANS TO SOLVE THE PROBLEM

According to an aspect of the invention, a flexible coil comprising: a plurality of sheet-like coils laminated together in a region sharing a magnetic flux, wherein each sheet-like coil has a coil section formed along a surface of an insulating sheet having flexibility; and a plurality of magnetic bodies that have flexibility and sandwich the plurality of the laminated sheet-like coils. The above structure can attain flexibility for a coil.

In addition to the aspect of the invention, the sheet-like coil may comprise a coil connecting portion installed in the inner periphery of the coil section and an electrode terminal portion installed in the outer periphery of the coil section, wherein the electrode terminal portion includes a terminal connecting portion that connects to the electrode terminal portion of the other sheet-like coil installed on a back side and wherein an end portion of the inner periphery of the coil section is connected to the coil connecting portion and an end of the outer periphery of the coil section is connected to the electrode terminal portion. In the above structure, the end portion in an inner periphery of the coil section can connect two coil sections so as to be one coil section, connecting the end portion in an outer periphery of each of coil sections to the electrode terminal portion.

Further, in addition to the aspect of the invention, the coil connecting portion and the terminal connecting portion may be through hole portions which form a conductive layer in each of the inner surface. This structure can realize the coil connecting portion and the terminal connecting portion without changing the size and the thickness of the flexible coil.

Further, in addition to the aspect of the invention, the flexible coil may have a structure where the other insulating sheet covers over a surface on which the coil section is exposed when the sheet-like coil is installed or a plurality of the sheet-like coils are laminated.

Further, in addition to the aspect of the invention, the width of the other insulating sheet may be smaller than the width of the sheet-like coil and the electrode terminal portion may be exposed from both outsides of the other insulating sheet.

Further, in addition to the aspect of the invention, one sheet-like coil including the coil section of which a diameter becomes smaller from a clockwise direction or a counter clock wise direction may be laminated with the other sheet-like coil including the coil section of which a diameter becomes lager from a clockwise direction or a counter clock wise direction.

Further, in addition to the aspect of the invention, one or more holes and one or more concave portions may be formed in a center and both ends of the sheet-like coil and the magnetic body may have a configuration which gets into the holes and the concave portions.

EFFECT OF THE INVENTION

The present invention can provide a coil having flexibility even if it comprises a core body.

10: flexible coil,
20, 30, 40, 50, 31', 41', 51': sheet-like coil
21, 31, 41, 51: sheet body (insulating sheet having flexibility)
22S, 32S, 42S, 52S: coil connecting portion
22Sh, 32Sh, 42Sh, 52Sh: through hole portion
23A, 23B, 23C, 23D: electrode terminal portion
23*h*, 33*h*, 43*h*, 53*h*: through hole portion (terminal connecting portion)
33A, 33B, 33C, 33D: electrode terminal portion
43A, 43B, 43C, 43D: electrode terminal portion
53A, 53B, 53C, 53D: electrode terminal portion
80, 81: magnetic body
91B, 92B, 93B, 94B, 95B, 96B: electrode terminal portion
91C, 92C, 93C, 94C, 95C, 96C: sheet body (insulating sheet having flexibility)
91*h*, 92*h*, 93*h*, 94*h*, 95*h*, 96*h*: through hole portion (terminal connecting portion)
91S, 92S, 93S, 94S, 95S, 96S: coil connecting portion
91Sh, 92Sh, 93Sh, 94Sh, 95Sh, 96Sh: through hole portion
101B, 102B, 103B, 104B: electrode terminal portion
101C, 102C, 103C, 104C sheet body (insulating sheet having flexibility)
101*h*, 102*h*, 103*h*, 104*h* through hole portion (terminal connecting portion)
101S, 102S, 103S, 104S coil connecting portion
101Sh, 102Sh, 103Sh, 104Sh through hole portion

DETAILED DESCRIPTION OF THE INVENTION

[First Embodiment]

A flexible coil 10 of a first embodiment of the invention will be explained with referring to FIG. 1 to FIG. 6.

Figure 1:
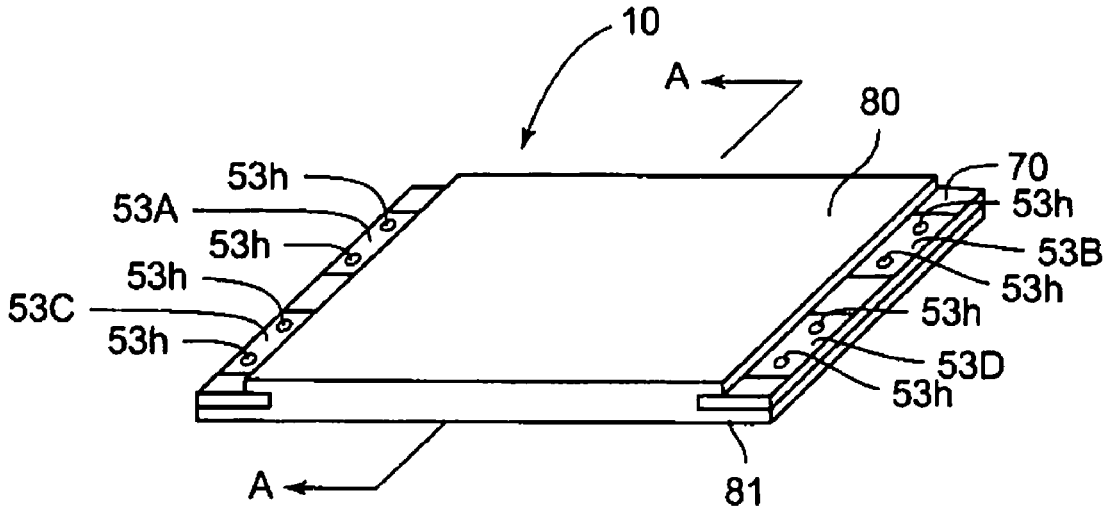
FIG. 1 is a perspective view showing an overall appearance of first embodiment of a flexible coil.
Figure 2:
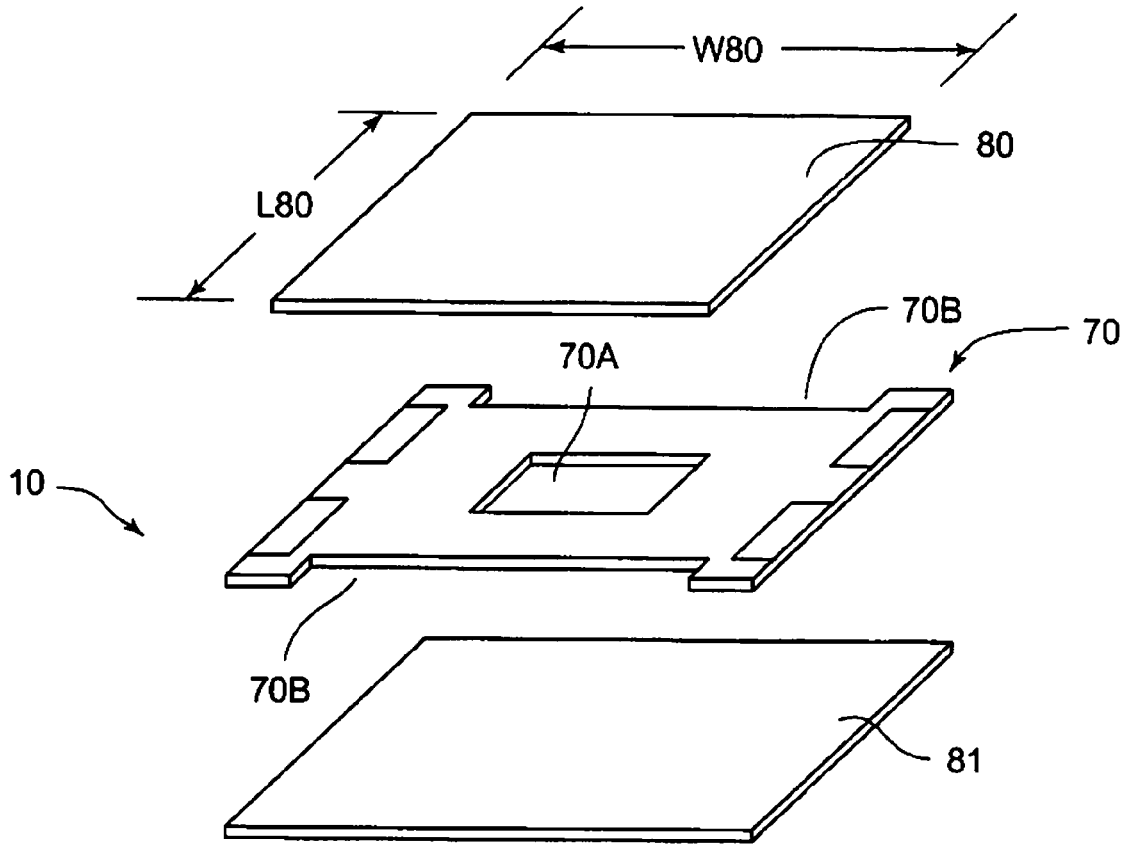
FIG. 2 is a perspective view showing a broken-down appearance of first embodiment of a flexible coil.
Figure 3:
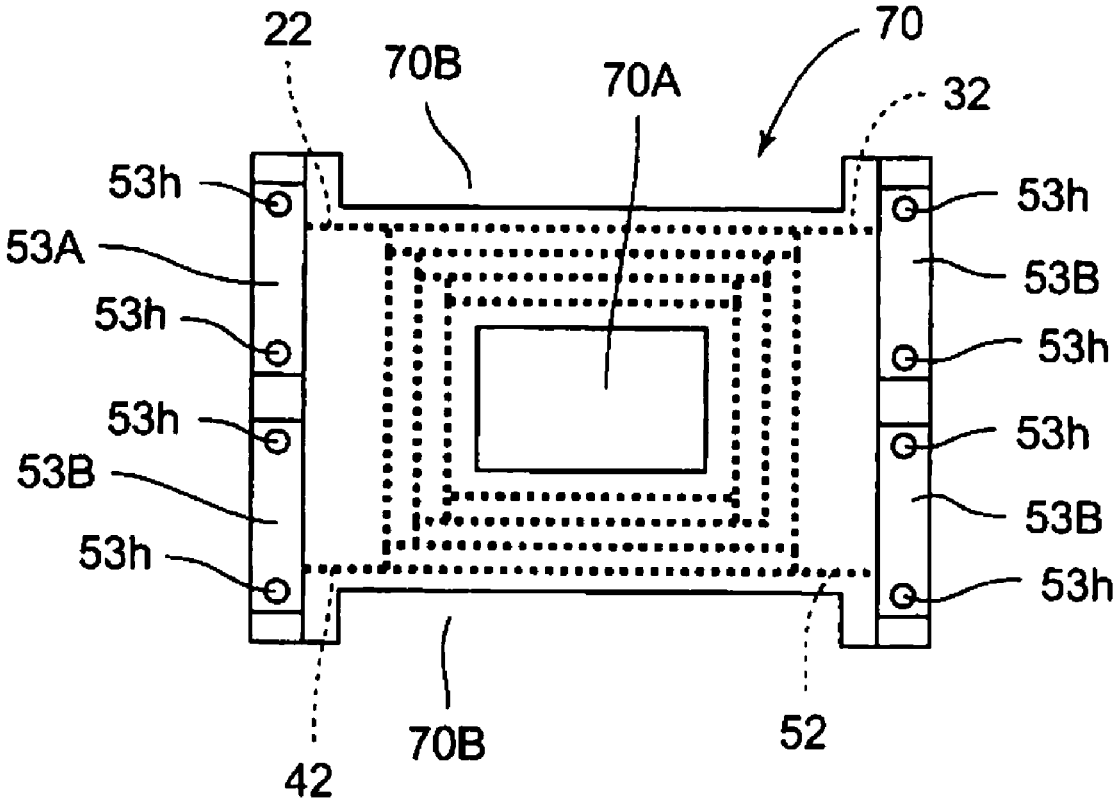
FIG. 3 is a plain view of a coil unit which is a part of first embodiment of a flexible coil.
Figure 4:
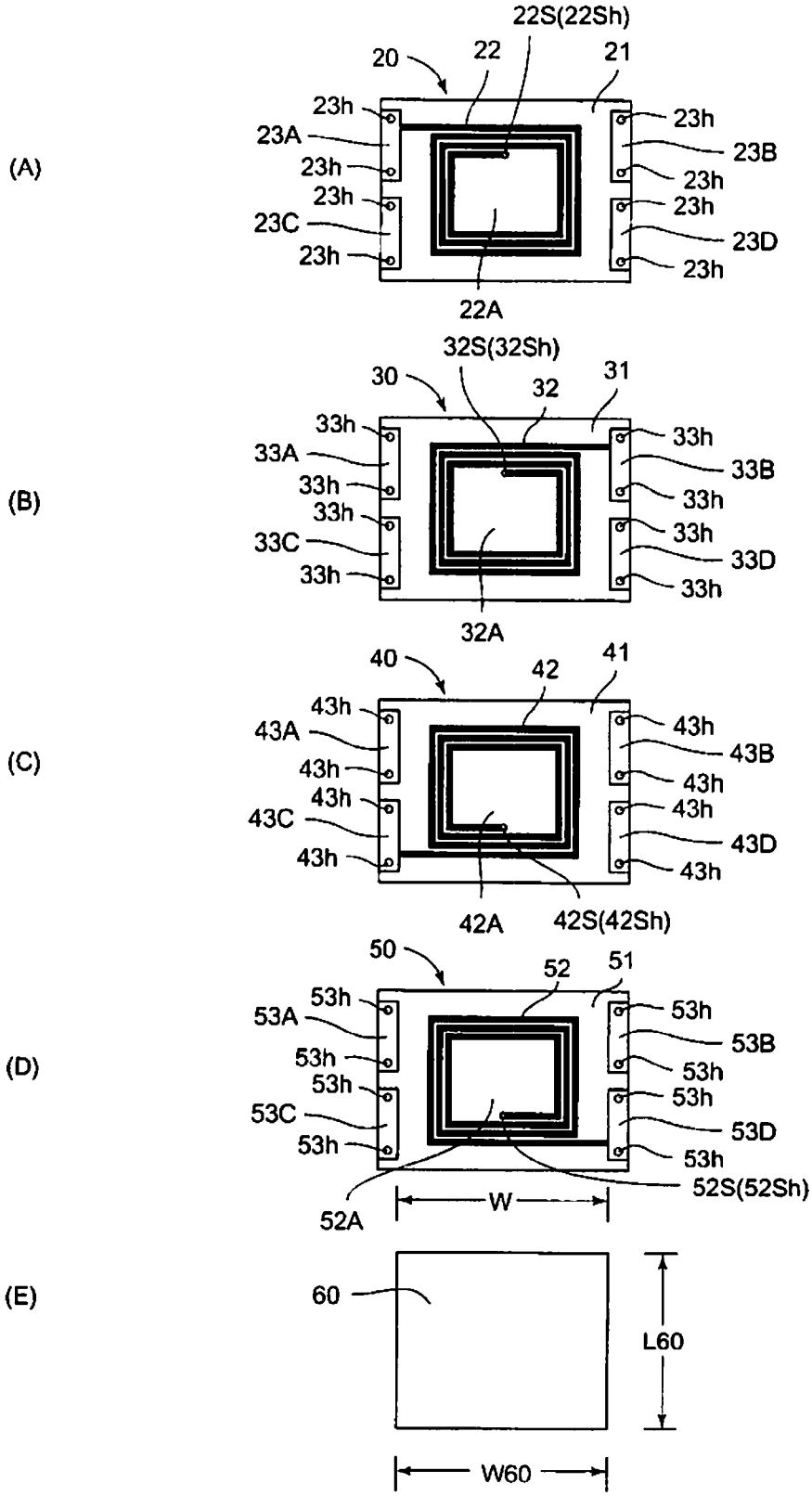
FIG. 4 is a broken-down view of a coil unit which is a part first embodiment of a flexible coil.
Figure 5:
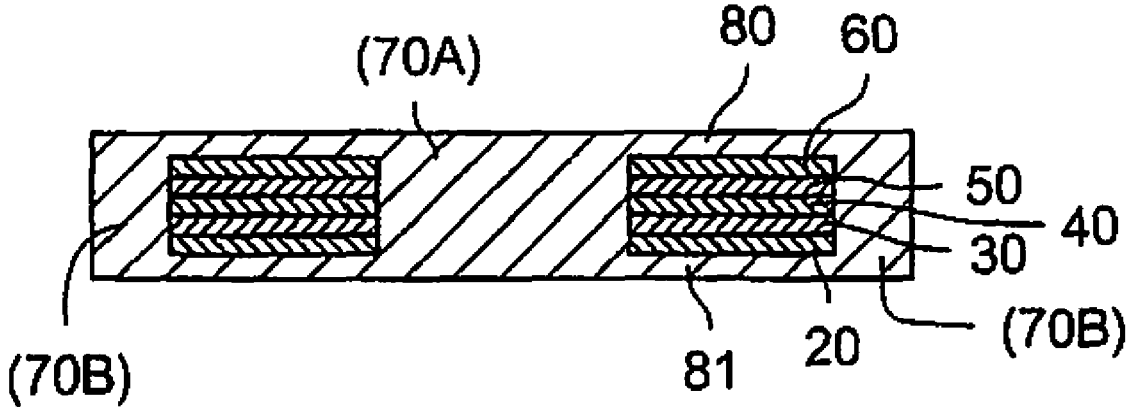
FIG. 5 is a cross section along A-A' line in FIG. 1 of first embodiment of a flexible coil.

FIG. 1 is a perspective view of an overall appearance of the flexible coil 10. FIG. 2 is a broken-out perspective view of an overall appearance of the flexible coil 10. FIG. 3 is a plain view of a coil unit 70. FIG. 4 is a broken-out view of the coil unit 70. FIG. 5 is a cross section along A-A' line in FIG. 1 of the flexible coil 10.

The coil unit 70 comprises four sheet-like coils 20, 30, 40, 50 shown in FIGS. 4 (A) to 4 (D) and an insulating sheet for covering 60 shown in FIG. 4 (E).

The structure of the sheet-like coil 20 and a method of manufacturing it will be explained with referring to FIG. 4 (A). The sheet-like coil 20 comprises a sheet body 21, a coil 22, a coil connecting portion 22S, four electrode terminal portions 23A, 23B, 23C, 23D and a through hole portion 23*h*. The coil 22 is a coil section formed on a surface of the sheet body 21. In the following explanation, the direction of connecting short sides of the sheet body 21 is defined as left and right directions (left and right sides) and the direction of connecting long sides is defined as upper and lower directions (upper and lower sides). Further, the surface on which a coil is formed in the sheet body 21 is a front surface (an upper surface) and the opposite surface of it is a back surface (a lower surface).

The sheet body 21 is composed of a film body having insulation and flexibility such as polyimide or the like and its plain shape is rectangular. The coil 22 has a rectangular winded shape of which winded direction is changed to 90 degrees along a plain shape on one side surface of the sheet body 21. A diameter of winding becomes smaller along a clockwise direction (the width of left and right directions or upper and lower directions in an inner periphery of the winded coil 22.) The coil connecting portion 22S is placed on the upper side of the sheet body 21, which is the center of the left and right side, and in an inner periphery of the winding of the coil 22.

The electrode terminal portion 23A is placed at the upper and left side on the surface of the sheet body 21 among electrode terminal portions 23A, 23B, 23C and 23D. The electrode terminal portion 23B is placed at the upper and right side on the surface of the sheet body 21. The electrode terminal portion 23C is placed at the lower and left side on the surface of the sheet body 21. The electrode terminal portion 23D is placed at the lower and right side on the surface of the sheet body 21. The shape of these electrode terminal portions 23A, 23B, 23C and 23D is a rectangular of which a longer side is along the direction of an edge of a short side portion. The two through hole portions 23*h* are placed on upper and lower directions in each of these electrode terminal portions 23A, 23B, 23C and 23D in order to form a terminal connecting portion.

A rectangular space region 22A where the coil 22 is not winded is formed within an inner periphery of the coil 22. The coil 22 is winded three times. An end portion placed at the outside periphery of the winding is connected to the electrode terminal portion 23A on an upper and left area. The other end portion placed at an inner periphery of the winding is connected to the coil connecting portion 22S.

The sheet-like coil 20 having the above structure is manufactured by the following processes.

First, a thin electrolytic copper foil is attached to an entire surface on one side of the sheet body 21 with an adhesive so that a thin copper foil layer is formed on the sheet body 21. A heat proof epoxy resin or a polyimide resin is used as an adhesive, in considering resistance to heat. Instead of a thin electrolytic copper foil, a rolled copper foil may be attached to form a copper foil layer.

The through hole portion 22Sh is formed in the coil connecting portion 22S of the sheet body 21 in which the copper foil layer is formed by drilling or laser irradiation. The through hole portions 23*h* are also formed by a similar way.

Then, a conductive material such as copper is deposited by electrolytic plating in an inner periphery of the through hole portion 22Sh in order to be electrically connected to the copper foil layer. Depositing a conductive material such as copper with plating in an inner periphery of the through hole portion 22Sh electrically connects the plated copper area with the copper foil layer to form the coil connecting portion 22S. Before plating copper, it is preferable that a conductive primer be coated in order that copper is easily plated.

A conductive material such as copper is also deposited by plating in an inner periphery of through hole portions 23*h* in order to be electrically connected to the copper foil layer. Depositing a conductive material such as copper with plating in an inner periphery of the through hole portions 23*h* electrically connects the plated copper area with the copper foil layer to form the through hole portions 23*h* as the terminal connecting portion. Before plating copper, it is preferable that a conductive primer be coated in order that copper is easily plated similarly to the plating to the through hole portion 22Sh.

Then, a resist layer is formed along the shapes of the coil 22, and electrode terminal portions 23A, 23B, 23C, and 23D. In other words, the resist layer is formed so that one end part of the coil 22 is connected to the plated copper area formed in the through hole portion 22Sh such as the coil connecting portion 22S and the other end part is connected to the electrode terminal portion 23A. Then, the coil 22, electrode terminal portions 23A, 23B, 23C, and 23D are formed by etching the resist layer.

Accordingly, the sheet body 21 has flexibility and the coil 22 has a thickness of the electrolytic copper foil or the rolled copper foil so that the sheet-like coil 20 becomes totally flexible.

Next, the structure of the sheet-like coil 30 shown in FIG. 4(B) and a method of manufacturing it will be explained.

The sheet-like coil 30 comprises a sheet body 31 having the same size as the sheet body 21, a coil 32 formed on the sheet surface of the sheet body 31, a coil connecting portion 32S, four electrode terminal portions 33A, 33B, 33C and 33D and through hole portions 33*h*.

The sheet-like coil 30 has the same structure as the sheet-like coil 20 and a method of manufacturing it is the same for the sheet-like coil 20 except that the configuration of the coil 32 is different from that of the coil 22 of the sheet-like coil 20 as the following. In other words, the coil 22 of the sheet-like coil 20 has a configuration in which the winding diameter becomes smaller along a clockwise direction. On the other hand, the coil 32 has a configuration in which the winding diameter becomes larger along a clockwise direction Further, in the sheet-like coil 20, the end portion at the outside periphery of winding of the coil 22 is connected to the electrode terminal portion 23A located at the upper and left position. On the other hand, in the sheet-like coil 30, the end portion at the outside periphery of winding of the coil 32 is connected to the electrode terminal portion 33B located at the upper and right position. The coil connecting portion 32S is located in the inner periphery of the coil 32 and the upper side of the sheet 31, which is a center along left and right directions. In other words, the position of the coil connecting portion 22S on the surface of the sheet body 21 (the position along the outside periphery of the sheet body 21) is the same position as the coil connecting portion 32S on the surface of the sheet body 31 (the position along the outside periphery of the sheet 31). Further, the coil connecting portion 32S (a through hole portion 32Sh) is connected to the end portion of an inner periphery of the winding of the coil 32.

The sheet-like coil 30 has the same structure as the sheet-like coil 20 except the above description. In other words, forming of the coil 32, electrode terminal portions 33A, 33B, 33C, 33D and through hole portions 32Sh and 33*h*, and plating copper within these through hole portions are the same forming as the above description for the sheet-like coil 20. The diameter and the configuration of inner periphery of the winding in the coil 22 are the same of that in the coil 32. The position of the space region 32A on the surface of the sheet body 31 (the position along the outside periphery of the sheet 31) is the same position as the space region 22A on the surface of the sheet body 21 (the position along the outside periphery of the sheet body 21).

Accordingly, the sheet body 31 has flexibility and the coil 32 has a thickness of the electrolytic copper foil or the rolled copper foil so that the sheet-like coil 30 also becomes totally flexible.

Next, the structure of the sheet-like coil 40 shown in FIG. 4(C) and a method of manufacturing it will be explained.

The sheet-like coil 40 comprises a sheet body 41 of which size is the same of the sheet body 21, a coil 42 which is formed on the sheet surface of the sheet body 41, a coil connecting portion 42S, four electrode terminal portions 43A, 43B, 43C, 43D and through hole portions 43*h*. The sheet-like coil 40 also has the same structure as the sheet-like coil 20 and formed by the same method of manufacturing the sheet-like coil 20 similarly to the sheet-like coil 30 except the following point being different from the coil 22 of the sheet-like coil 20. In other words, the coil 22 of the sheet-like coil 20 has a configuration in which a winding diameter becomes smaller along a clockwise direction. On the other hand, the coil 42 has a configuration in which a winding diameter becomes larger along a clockwise direction.

Further, in the sheet-like coil 20, the end portion located at the outer periphery of the winding of the coil 22 is connected to the electrode terminal portion 23A located at the left and upper area. In the sheet-like coil 40, the end portion located at the outer periphery of the winding of the coil 42 is connected to the electrode terminal portion 43C located at the left and lower area. Further, in the sheet-like coil 20, the coil connecting portion 22S is placed on the upper area of the sheet body 21, which is a center along left and right directions. In the sheet-like coil 40, the coil connecting portion 42S is located in the inner periphery of the coil 42 and placed on the lower area of the sheet body 41, which is a center along left and right directions. The coil connecting portion 42S (the through hole portion 42Sh) is connected to the end portion of the inner periphery of the winding of the coil 42.

The sheet-like coil 40 has the same structure as the sheet-like coil 20 except the above description. In other words, the coil 42, electrode terminal portions 43A, 43B, 43C, 43D and through hole portions 42Sh and 43*h* are formed and the inside of these through hole portions are plated with copper by the same method as forming the sheet-like coil 20.

The diameter and the configuration of the winding in the inner periphery of the coil 42 are the same ones as the diameter and the configuration of the winding in the inner periphery of the coil 22. The position (the position of the outer periphery of the sheet body 41) in which the space region 42A is formed on the sheet 41 is the same position as position (the position of the outer periphery of the sheet body 21) in which the space region 22A is formed on the sheet body 21. In the sheet-like coil 40, the sheet body 41 has flexibility similarly to the sheet-like coil 20, and the coil 42 is formed with an electrolytic copper thin film and has a thickness of a rolled copper thin film, making the sheet-like coil 30 totally hold flexibility.

In the embodiment, the sheet-like coil 40 is a thing which is obtained by rotating the sheet-like coil 30 by 180 degree.

Next, the structure of the sheet-like coil 50 and a method of manufacturing it will be explained with referring to FIG. 4 (D).

The sheet-like coil 50 comprises a sheet body 51 of which size is the same as the sheet body 21, a coil 52 which is formed on the sheet surface of the sheet body 51, a coil connecting portion 52S, four electrode terminal portions 53A, 53B, 53C, 53D and through hole portions 53*h*.

The sheet-like coil 50 has the same structure as the sheet-like coil 20 and formed by the same method as manufacturing the sheet-like coil 20 similarly to the sheet-like coil 40 except the following point being different from the coil 22 of the sheet-like coil 20. In other words, in the sheet-like coil 20, the end portion located at the outer periphery of the winding of the coil 22 is connected to the electrode terminal portion 23A located at the left and upper area. In the sheet-like coil 50, the end portion located at the outer periphery of the winding of the coil 52 is connected to the electrode terminal portion 53D located at the right and lower area.

Further, in the sheet-like coil 20, the coil connecting portion 22S is placed on the upper area of the sheet body 21, which is a center along left and right directions. In the sheet-like coil 50, the coil connecting portion 52S is located in the inner periphery of the coil 52 and placed on the lower area of the sheet body 51, which is a center along left and right directions. The coil connecting portion 52S (the through hole portion 52Sh) is connected to the end portion of the inner periphery of the winding of the coil 52.

Here, the position (the position of the outer periphery of the sheet body 51) at which the coil connecting portion 52S is placed on the sheet body 51, is the same position as position (the position of the outer periphery of the sheet body 41) at which the coil connecting portion 42S is placed on the sheet body 41.

The sheet-like coil 50 has the same structure as the sheet-like coil 20 except the above description. In other words, the coil 52, electrode terminal portions 53A, 53B, 53C, 53D and through hole portions 52Sh, 53*h* are formed, and the inside of these through hole portions are plated with copper by the same method as forming the sheet-like coil 20.

The diameter and the configuration of the winding in the inner periphery of the coil 52 are the same ones as the diameter and the configuration of the winding in the inner periphery of the coil 22. The position (the position of the outer periphery of the sheet body 51) in which the space region 52A is formed on the sheet 51 is the same position as position (the position of the outer periphery of the sheet body 21) in which the space region 22A is formed on the sheet body 21.

Similarly to the sheet-like coil 20, in the sheet-like coil 50, the sheet body 51 has flexibility and the coil 52 is formed with a thickness of an electrolytic copper thin film or a rolled copper thin film, making the sheet-like coil 50 totally hold flexibility.

In the embodiment, the sheet-like coil 50 is a thing which is obtained by rotating the sheet-like coil 20 by 180 degree.

An insulating sheet for a cover 60 shown in FIG. 4(E) has a width (L60) along upper and lower directions which is the same width as the sheet body 20 (30, 40, and 50). Further, the width (W60) along left and right directions is almost equal to a space (w) along left and right directions as shown in FIG. 4 (D) where electrode terminal portions 53A, 53B or 53C, 53D are installed. The insulating sheet for a cover 60 is composed of a polyimide film which is the same material as the sheet body 20 (30, 40 and 50.)

These sheet-like coils 20, 30, 40, 50 described above are laminated in this order in order that the each surface of coils in these sheet-like coils does not face the other surface of the other coil, in other words the front surface of one coil sheet faces the back surface of the other sheet-like coil.

To explain further in details, the sheet-like coil 20 and the sheet-like coil 30 are laminated so as to make the side of the sheet body 31 (in which the coil 32 is not formed) of the sheet-like coil 30 face the surface of the sheet-like coil 20 in which the coil 22 is installed. Then, the sheet-like coil 40 is laminated over the sheet-like coil 30 so as to make the side of the sheet body 41 (in which the coil 42 is not formed) of the sheet-like coil 40 face the surface of the sheet-like coil 30 in which the coil 32 is installed. Further, the sheet-like coil 40 is laminated over the sheet-like coil 50 so as to make the side of the sheet body 51 (in which the coil 52 is not formed) of the sheet-like coil 50 face the surface of the sheet-like coil 40 in which the coil 42 is installed. Upper and lower or left and right directions of these laminated sheet-like coils 20, 30, 40 and 50 are adjusted so that the electrode terminal portions 23A, 33A, 43A and 53A are positioned on a left and upper area.

When the sheet-like coil 30 is laminated on the sheet-like coil 20, such laminating makes the coil connecting portion 22S face the coil connecting portion 32S along upper and lower directions. Accordingly, the coil connecting portion 22S faces the coil connecting portion 32S along upper and lower directions each other, making a copper plated surface within the through hole portion 32Sh be connected to a copper plated surface within the thorough hole portion 22Sh. Further, the coil 22 is connected to the coil 32 with the coil connecting portions 22S and 32S, forming a singularly linked coil. Electrode terminal portions 23A and 33B become electrode terminal portions of a coil where coils 22 and 32 are singularly linked together.

In general, when a coil is formed on the surface of the sheet body and an electrode terminal portion for input and output is installed at the periphery of the coil, a part of inner winded conductive wire which is drawn out from an inner periphery to an outer periphery is crossed with a winded conductive wire. However, in above described case, a part of conductive wires crossing each other has to be insulated, making a structure being complex.

On the other hand, in the above described sheet-like coils 20 and 30, these sheet-like coils are laminated so as to connect the coil connecting portion 22S to the coil connecting portion 32S only. This arrangement insulates a space between the coil 22 and the coil 32 using the sheet body 31 except a connection of the coil connecting portion 22S to the coil connecting portion 32S and places electrode terminal portions 23A and 33B at the outer periphery of these coils as electrode terminal portions for input and output.

When the sheet-like coil 50 is laminated on the sheet-like coil 40, such lamination makes the coil connecting portion 42S face the coil connecting portion 52S along upper and lower directions. Accordingly, the coil connecting portion 42S faces the coil connecting portion 52S along upper and lower directions each other, making a copper plated surface within the thorough hole portion 52Sh be connected to a copper plated surface within the thorough hole portion 42Sh. Further, the coil 42 is connected to the coil 52 with the coil connecting portions 42S and 52S, forming a singularly linked coil. Electrode terminal portions 43C and 53C become electrode terminal portions of a coil where coils 42 and 52 are singularly linked together.

In the above described sheet-like coils 40 and 50, these sheet-like coils are laminated so as to connect the coil connecting portion 42S to the coil connecting portion 52S only similarly to the sheet-like coils 20 and 30. This arrangement insulates a space between the coil 42 and the coil 52 using the sheet body 51 except a connection of the coil connecting portion 42S to the coil connecting portion 52S and places electrode terminal portions 43C and 53D at the outer periphery of these coils as electrode terminal portions for input and output.

Further, sheet-like coils 20, 30, 40 and 50 are laminated so that four electrode terminal portions installed at upper and lower area, and left and right sides of each sheet-like coil are overlapped over other electrode terminal portions of other sheet-like coil as the same positional relationship.

In other words, such laminated structure overlaps electrode terminal portions 23A, 33A, 43A and 53A each other along upper and lower directions. Further electrode terminal portions 23B, 33B, 43B and 53B are overlapped each other along upper and lower directions. Further, electrode terminal portions 23C, 33C, 43C and 53C are overlapped each other along upper and lower directions. Further electrode terminal portions 23D, 33D, 43D and 53D are overlapped each other along upper and lower directions.

The above structure makes a copper plated portion formed within an inner surface of the through hole portion connect the electrode terminal portion placed in the backside, connecting electrode terminal portions each other with the through hole portion. Such thought hole portion is formed in the electrode terminal portion placed on the front surface.

In other words, the inner surfaces of the through hole portions 33*h*, 43*h*, 53*h* of electrode terminal portions 33A, 43A, 53A are plated with copper. Hence, the electrode terminal portion 53A is connected to the electrode terminal portion 43A located at the back side of the electrode terminal portion 53A with the through hole portions 53*h*. Further, the electrode terminal portion 43A is connected to the electrode terminal portion 33A located at the back side of the electrode terminal portion 43A with the through hole portions 43*h*. Further, the electrode terminal portion 33A is connected to the electrode terminal portion 23A located at the back side of the electrode terminal portion 33A via the through hole portions 33*h*.

Other electrode terminal portions 23B, 33B, 43B and 53B are also connected to other electrode terminal portions 23C, 33C, 43C and 53C and other electrode terminal portions 23D, 33D, 43D and 53D via the through hole portions 33*h*, 43*h* and 53*h*.

As described above, the insulating sheet for a cover 60 is laminated over the sheet-like coil 50 which is one of after sheet-like coils 20, 30, 40 and 50 are laminated without covering over electrode terminal portions 53A, 53B, 53C and 53D so that the coil unit 70 is formed as shown in FIG. 3.

As shown in FIG. 4 (E), the width (W60) of the insulating sheet for a cover 60 has the same width (W) as left and right directions of the electrode terminal portions 53C and 53D, covering only the coil 52 without covering electrode terminal portions 53A, 53B, 53C and 53D.

Here, when the sheet-like coils 20, 30, 40 and 50 are laminated as described above, their outer edges are mostly aligned together since the sizes and configurations of the sheet bodies 21, 31, 41 and 51 are the same together.

Space regions 22A, 32A, 42A and 52A placed at the same position and on the surfaces of sheet bodies 21, 31, 41, and 51 are overlapped each other along upper and lower directions (laminated directions) of sheet-like coils 20, 30, 40 and 50. In other words, each of coils 22, 32, 42 and 52 shares its magnetic circuit with each of space regions 22A, 32A, 42A and 52A.

Here, the coil 32 is insulated from the coil 42 because of existence of the sheet body 41 between the coils 32 and 42.

As described above, the sheet-like coils 20, 30, 40 and 50 and the insulating sheet for a cover 60 are laminated. Then, the insides of space regions 22A, 32A, 42A and 52A are punched out like a rectangle to form a hole portion 70A (see FIG. 3.)

Further, upper and lower side edge portions of the sheet-like coils 20, 30, 40 and 50 and the insulating sheet for a cover 60 are punched out so as to make upper and lower side edge portions be a rectangular U-shape toward inner sides from these lower side edge portions to form a concave portion 70B.

In other words, the coil unit 70 includes the hole portion 70A inside and the concave portion 70B is formed at the upper and lower side edges.

The coil unit 70 formed by the method described above has flexibility since sheet-like coils 20, 30, 40 and 50 and the insulating sheet 60 have flexibility.

Next, the coil unit formed by the above method is thermally pressed while being sandwiched with magnetic bodies 80 and 81 from both sides along upper and lower directions as shown in FIG. 2.

The magnet body 80 formed on the front surface of the sheet-like coil 50 has the width (L80) along upper and lower directions and the width (W80) along left and right directions which are almost equal to that of the insulating sheet for a cover 60 and does not cover over electrode terminal portions 53A, 53B, 53C and 53D.

The magnet body 81 formed on the back surface of the sheet-like coil 20 is formed on the surface which is the almost same size as the sheet-like coil 20 and covers over the entire back surface of the sheet body 21 of the sheet-like coil 20.

Magnetic bodies 80 and 81 are composed of a flexible and magnetic thin plate body or a sheet body in which are formed by mixing an elastomer resin with iron powders as magnetic powders. Hence, when these magnetic bodies 80 and 81 are thermally pressed with sandwiching the coil unit 70, magnetic bodies get into the hole portion 70A and the concave portion 70B. Further, magnetic bodies 80 and 81 are integrated into a single magnetic body, forming a core for coils 22, 32, 42, and 52.

As a result, magnetic bodies 80 and 81 exist in the hole portion 70A and the concave portion 70B as shown in FIG. 5 which is a cross section along the line A-A in FIG. 1. When a current flows in coils 22, 32, 42 and 52, a closed magnetic circuit is formed around the coils 22, 32, 42 and 52.

The flexible coil 10 formed as described above, has flexibility since the coil unit 70 has flexibility and magnetic bodies 80, 81 has also flexibility. Accordingly, the flexible coil 10 includes magnetic bodies 80 and 81 as a core and flexibility.

In the flexible coil 10, electrode terminal portions 53A, 53B, 53C and 53D are exposed from the magnetic body 80 as shown in FIG. 1. Electrode terminal portions 53A and 53B work as electrode terminal portions for coils 22 and 32 singularly linked together and electrode terminal portions 53C and 53D work as electrode terminal portions for coils 42 and 52 singularly linked together.

In other words, the electrode terminal portion 53A is electrically connected to the electrical terminal portion 23A which connects to an end part of the coil 22 via the through hole portions 43*h* in the electrode terminal portion 43A and the through hole portions 33*h* in the electrode terminal portion 33A. The through hole portions 43*h* and the through hole portions 33*h* singularly linked together oppose to two through hole portions 53*h* installed in the electrode terminal portion 53A.

Further, the electrode terminal portion 53B is electrically connected to the electrical terminal 23B which is connected to a part of the coil 32 via the through hole portions 43*h* in the electrode terminal portion 43B and the through hole portions 33*h* in the electrode terminal portion 33B. The through hole portions 43*h* and the through hole portions 33*h* singularly linked together oppose two through hole portions 53*h* installed in the electrode terminal portion 53B.

The coil 22 is electrically connected to the coil 32 together via the through hole portion 32Sh. Hence, the electrode terminal portions 53A and 53B work as electrode terminal portion of the coils 22 and 32 which are singularly linked together.

Further, the electrode terminal portion 53C is electrically connected to the electrode terminal portion 43C via two through hole portions 53*h* which are installed on the electrode terminal portion 53C. The electrode terminal portion 43C is electrically connected to an end part of the coil 42. The electrode terminal portion 53D directly becomes an electrode terminal portion of the coil 52.

The coil 52 is electrically connected to the coil 42 together via the through hole portion 52Sh. Hence, the electrode terminal portions 53C and 53D work as electrode terminal portion of the coils 42 and 52 which are singularly linked together.

The flexible coil 10 composed of the above structure is configured as a so-called two-circuits and four-terminals coil.

In other words, the coil 22 and the coil 32 which are connected together via the coil connecting portion 32S constitute a first coil (or a secondary coil) and the coil 52 and the coil 42 which are connected together via the coil connecting portion 52S constitute a secondary coil (or a first coil.) Then, the electrode terminal portions 53A and 53B work as input and output terminals of the coil 22 and the coil 32. The electrode terminal portions 53C and 53D work as input and output terminals of the coil 42 and the coil 52.

In the embodiment described above, the sheet bodies 21, 31, 41 and 51 are made of polyimide film. But, they may be made of a resin such as a polyethylene terephthalate resin and a polyethylene naphthalene resin.

Further, the magnetic body was manufactured by mixing an elastomer resin having flexibility with iron powders as magnetic powders. But, silicone rubber or epoxy resin which can form rubber-like cross linkage, can be used as a flexible material. And then, those resin and soft metal powders such as iron powders, sendust powders, or_permalloy powders or the like, can be mixed for manufacturing the magnetic body.

Further, in the embodiment, the numbers of winding in the first side is the same numbers as winding in the secondary side. But, the numbers of winding in the first side may be made to be different from the numbers of winding in the secondary side. Such different winding boosts a voltage applied to either of coils desponding on the ratio of numbers of winding as a transformer.

Here, electrode terminal portions 23B, 23C, 23D, 33C, 33D and 43D are unnecessary since lower sides of them are not electrode terminal portions connected to the coils 22 and 32.

In other words, for example, it is not necessary that the electrode terminal portion 53A is connected to the electrode terminal portion 23A connected to the coil 22 via through hole portions 43*h* and 33*h* such as electrode terminal portions 33A and 43A.

Hence, it is not necessary that these electrodes are formed in view of function for the flexible coil 10, but these electrodes do not work their function even when they are formed. Hence, a mask pattern for forming electrode terminal portions is shared for all sheet-like coils 20, 30, 40 and 50 so as to reduce a manufacturing cost. In other words, a mask pattern for forming a resist layer portion is shared for all sheet-like coils 20, 30, 40 and 50. The resist layer portion has a configuration which corresponds to the configuration of the electrode terminal portion including the copper thin film formed on the sheet body.

Figure 6:
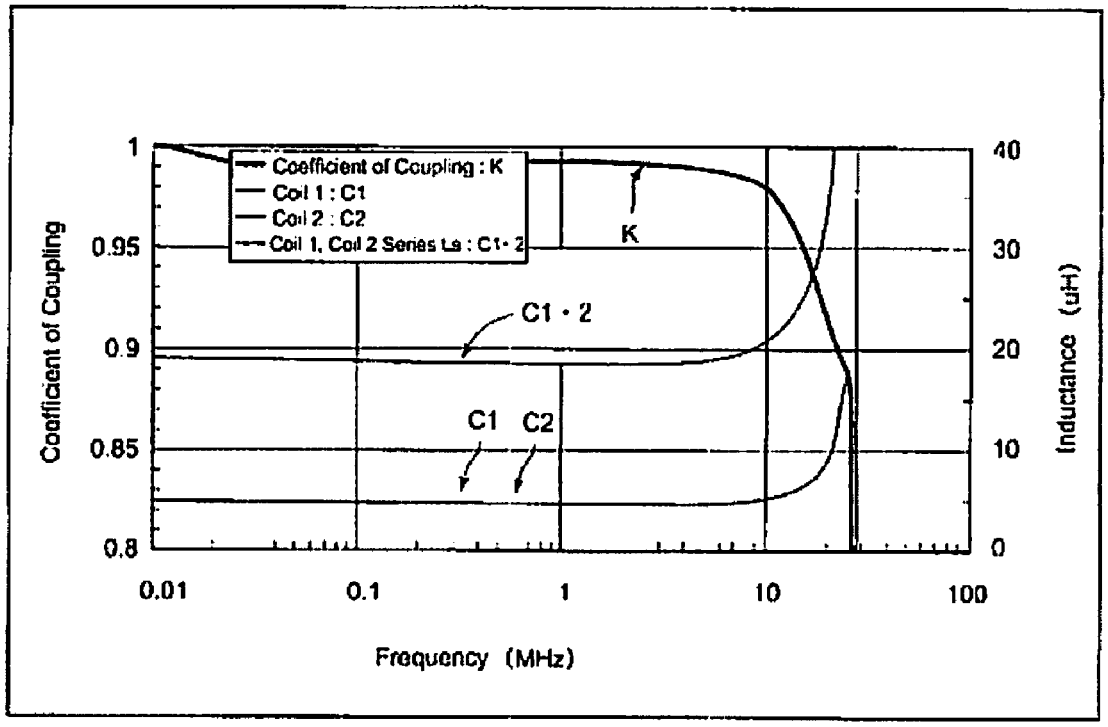
FIG. 6 is a graph showing a relationship between coupling coefficient and an inductance property of first embodiment of a flexible coil.

The flexible coil 10 in the embodiment can attain a high coupling coefficient as shown in a graph of FIG. 6. This high coupling coefficient can be attained since the sheet body 41 made of non magnetic polyimide is sandwiched between a first coil and secondary coil. In FIG. 6, "coil 1" is indicated as a coil comprising the coil 22 and the coil 32 and "coil 2" is indicated as a coil comprising the coil 42 and the coil 52.

[Second Embodiment]

Next, the flexible coil 10 regarding a second embodiment will be explained referring to FIG. 7 and FIG. 8. In the second embodiment, only a coil unit 70' in the flexible coil 10 is different from a coil unit 70 in the flexible coil 10 in the first embodiment. The structure of it and a method of manufacturing it will be mainly explained.

The method of manufacturing the coil unit 70' is different from the method of manufacturing the coil unit 70, the coil unit 70' has a structure different from the coil unit 70 due to such different manufacturing method. But, basic structure of the coil unit 70' is the same as the coil unit 70. Hence, the same numeral references in the coil unit 70 shown in FIG. 4 are applied to components in the coil unit 70' and their explanation will be omitted. The coil unit 70' is a two-circuits and four-terminals coil such as the coil unit 70.

Figure 7:
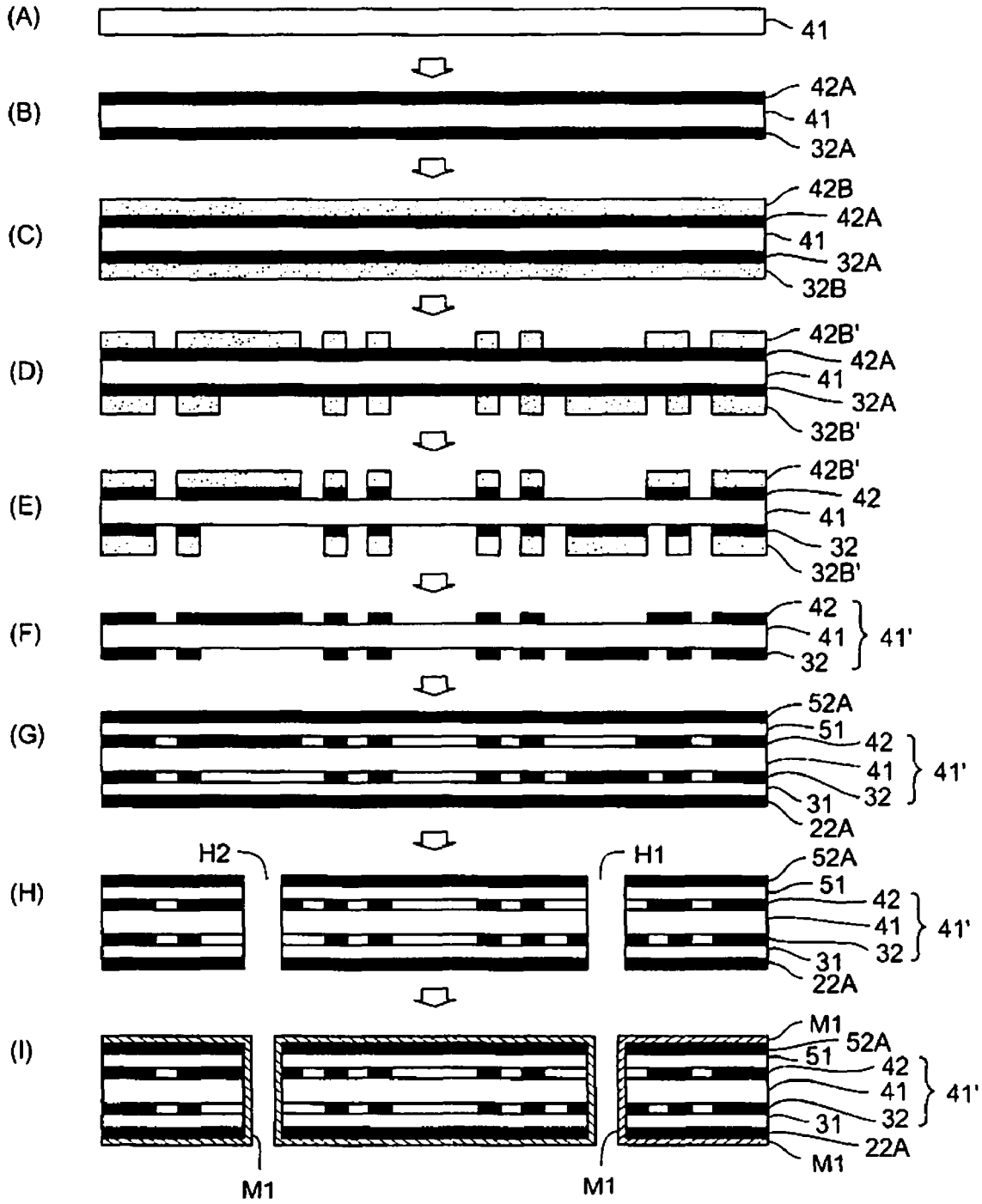
FIG. 7 is a diagram showing processes of manufacturing second embodiment of a flexible coil.

First, the sheet body 41 is prepared as shown in FIG. 7 (A) Then, an electrolytic copper foil is attached to entire front and back surfaces of the sheet body 41 to form a copper foil layers 32A and 42A (FIG. 7 (B)). Then, the resist layer 32B is coated on the back surface of the copper foil layer 32A and the resist layer 42B is also coated on the front surface of the copper foil layer 42A. Then, as shown in FIG. 7 (D), the resist layer 32B is etched to form a resist pattern 32B' of which shape corresponds to pattern configurations of the coil 32 and electrode terminal portions 33A, 33B, 33C and 33D (FIG. 4 (B)). Further, the resist layer 42B is etched to form a resist layer pattern 42B' of which shape corresponds to pattern configurations of the coil 42 and electrode terminal portions 43A, 43B, 43C and 43D (FIG. 4 (C)).

Then, copper foils are etched (FIG. 7 (E)) and resist layers are removed (FIG. 7 (F)) to form the coil 42 and electrode terminal portions 43A, 43B, 43C and 43D. The coil 42 and electrode terminal portions 33A, 33B, 33C and 33D are formed on the back surface of the sheet body 41. In other words, the sheet-like coil 41' comprising the coil 32 and the coil 42 on the sheet body 41 is formed.

Then, as shown in FIG. 7 (G), the sheet body 51 is laminated on the front surface of the sheet-like coil 41' while sandwiching the coil 42 and electrode terminal portions 43A, 43B, 43C, and 43D and being attached to their surfaces with an adhesive. Further, the sheet body 31 is formed on the back surface of the sheet-like coil 41' while covering over the coil 32 and electrode terminal portions 33A, 33B, 33C and 33D and being attached to their surfaces with an adhesive. Further, an electrolytic copper foil is attached to the front surface of the sheet body 51 with an adhesive to form a copper foil layer 52A. An electrolytic copper foil is attached to the back surface of the sheet body 31 with an adhesive to form a copper foil layer 22A.

Then, as shown in FIG. 7 (H), a through hole portion H1 is formed at the position corresponding to the through hole portions 22Sh and 32*h* shown in FIGS. 4 (A) and 4 (B). Further, a through hole portion H2 is formed at the position corresponding to the through hole portions 42Sh and 52Sh shown in FIGS. 4 (C) and 4 (D). Other through hole portions not shown in any figures are formed at the position corresponding to the through hole portions 23*h*, 33*h*, 43Sh and 53*h* formed on electrode terminal portions shown in FIGS. 4 (A) to 4 (E).

Then, as shown in FIG. 7 (I), a layer M1 is plated while covering over the inner surfaces of the through hole portions H1 and H2, the inner surfaces of the through hole portion not shown in the figure corresponding to the through hole portions 23*h*, 33*h*, 43*h* and 53*h* and entire surfaces of copper foil layers 22A and 52A.

Figure 8:
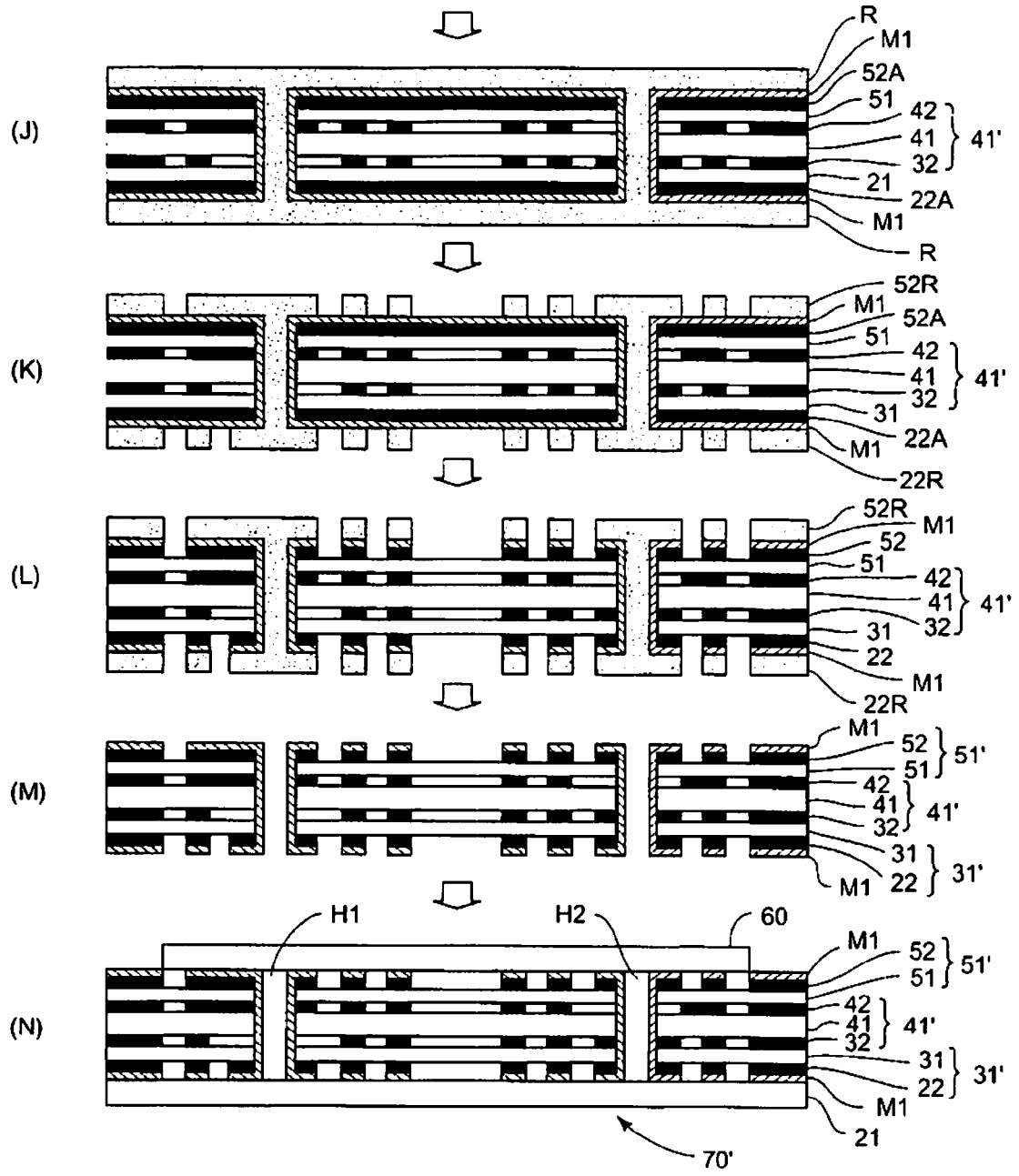
FIG. 8 is a diagram showing processes of manufacturing second embodiment of a flexible coil.

Then, a resist layer R is coated covering over the plated layer M1 and the inner surface of through hole portions H1 and H2 (FIG. 8 (J)). Then, as shown in FIG. 8 (K), the resist layer R on the front surface of the copper foil layer 52A is etched to form a resist layer pattern 52R of which shape corresponds to pattern configurations of the coil 52 and electrode terminal portions 53A, 53B, 53C and 53D (see FIG. 4 (D)). Further, the resist layer R on the back surface of the copper foil layer 22A is etched to form a resist pattern 22R of which shape corresponds to pattern configurations of the coil 22 and electrode terminal portions 23A, 23B, 23C and 23D (FIG. 4 (A)). Then, copper foils are etched (FIG. 8 (L)) and resist layers are removed (FIG. 8 (M)) to form the coil 52 and electrode terminal portions 53A, 53B, 53C and 53D on the front surface of the sheet body 51. Further, the coil 22 and electrode terminal portions 23A, 23B, 23C and 23D are formed on the back surface of the sheet body 31.

In other words, the sheet-like coil 51' comprising the coil 52 on the sheet body 51 is laminated on the surface of the coil 42 of the sheet-like coil 41'. Further, the sheet-like coil 31' comprising the coil 22 on the sheet body 31 is laminated on the surface of the coil 32 of the sheet-like coil 41'.

Then, as shown in FIG. 8 (N), the insulating sheet for a cover 60 is laminated on the front surface of the sheet-like coil 51' while covering over the coil 52 and being attached to the coil 52 with an adhesive. Further, the sheet body 21 is laminated on the back surface of the sheet-like coil 31' while covering over the coil 22 and electrode terminal portions 23A, 23B, 23C and 23D and being attached to their surfaces with an adhesive.

A hole portion 70A is formed by punching through the insides of spaces 22A, 32A, 42A and 52A of the coils 22, 32, 42 and 52 with a rectangular shape while the sheet-like coils 41', 51' and 31', the sheet body 60 and the sheet body 21 are laminated each other. Further the concave portion 70B is punched so as to depress upper and lower edge side portions of the sheet-like coil 41', the sheet-like coil 51' the sheet-like coil 31', the insulating sheet for a cover 60 and the sheet body 21 toward inside from these upper and lower edge side portion.

The coil unit 70' formed by the above method comprises the coil 22 and the coil 32 which are connected each other via the plated layer M1 formed in the inside of the through hole portion H1. The coil 22 and the coil 32 are singularly linked. Electrode terminal portions 23A and 33B become electrode terminal portions of singularly linked coils 22 and 32. Further, the coil 42 is connected to the coil 52 via the plated layer M1 formed in the inner surface of the through hole portion H2 and the coil 42 and the coil 52 are singularly linked together. Electrode terminal portions 43C and 53D become electrode terminal portions of coils 42 and 52 singularly linked together.

Electrode terminal portions 23A, 33A, 43A and 53A are connected each other via the plated layer M1 formed in the inner surface of the through hole portion not shown in any figures. Electrode terminal portions 23B, 33B, 43B and 53B, electrode terminal portions 23C, 33C, 43C and 53C and electrode terminal portions 23A, 33A, 43A and 53A are connected each other via the plated layer M1 formed in the inner surface of the through hole portion not shown in any figures. In other words, the electrode terminal portion 53A is connected to the electrode terminal portion 23A which is one of electrode terminal portions for the coil 22 and the coil 32 singularly linked together. The electrode terminal portion 53B is connected to the electrode terminal portion 33B which is the other terminal. Hence, electrode terminal portions 53A and 53B work as electrode terminal portions for the coils 22 and 32 singularly linked together. The electrode terminal portion 53C is connected to the electrode terminal portion 43C which is one of electrode terminal portions for the coil 42 and the coil 52 singularly linked together. Hence, electrode terminal portions 53C and 53D work as electrode terminal portions for the coils 42 and 52 singularly linked together.

Magnet bodies 80 and 81 are laminated on the coil unit 70' formed as described above so as to constitute the flexible coil 10.

(First Modification)

Figure 9:
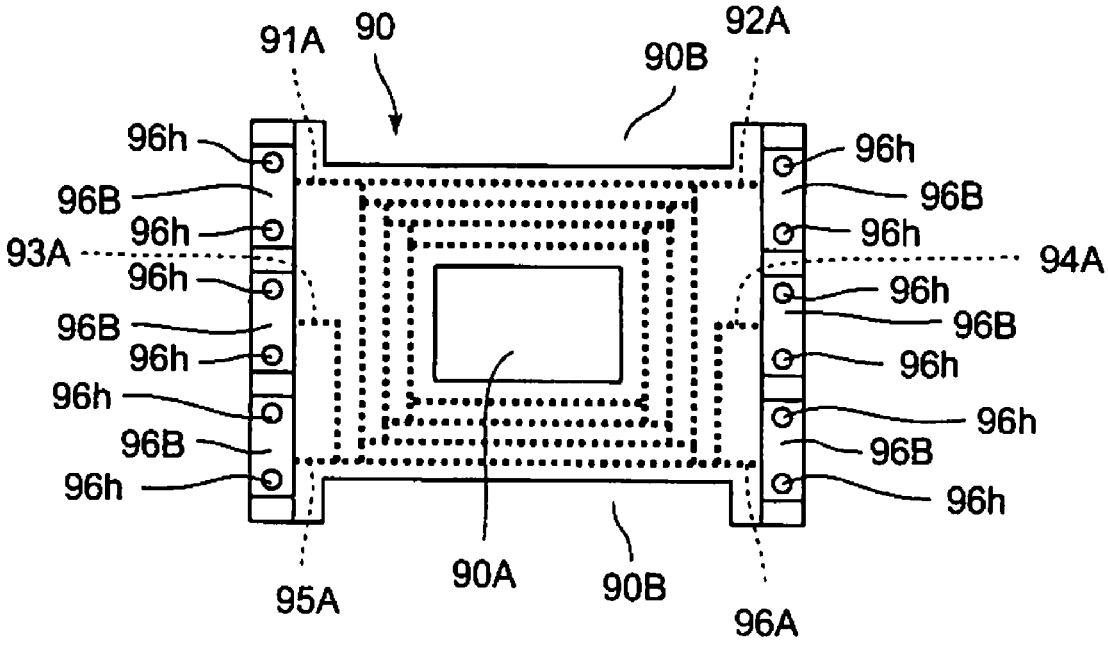
FIG. 9 is a plain view of a first modification of the coil unit included in the first embodiment of a flexible coil.

The coil unit 70 of the flexible coil 10 in the first embodiment is two-circuits and four terminals coil. On the other hand, FIGS. 9 and 10 show a coil unit 90 comprising three-circuits and six-terminals coil.

Figure 10:
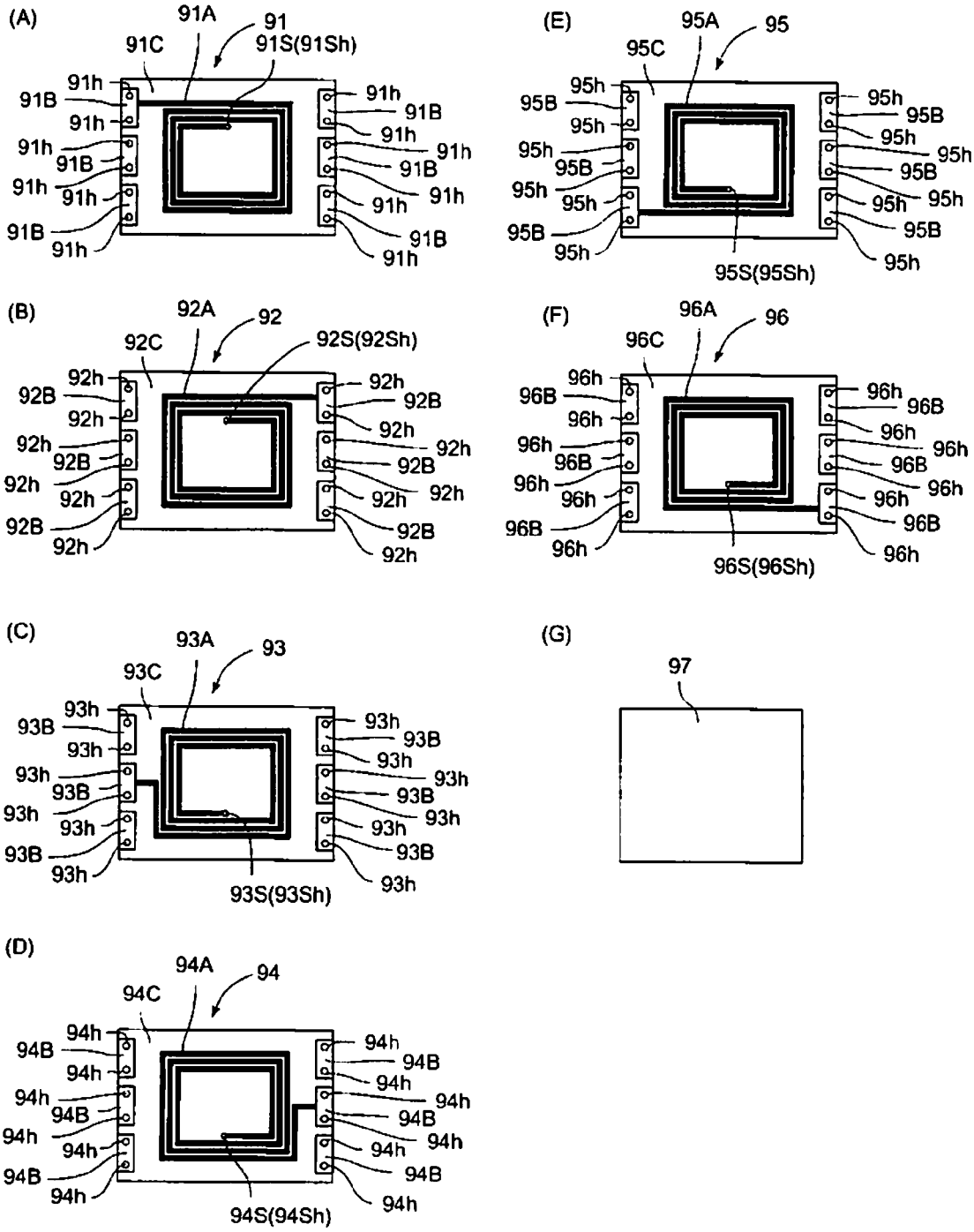
FIG. 10 is a broken-down view of the first modification of the coil unit included in the first embodiment of a flexible coil.

The coil unit 90 comprises six sheet-like coils 91, 92, 93, 94, 95 and 96 shown in FIGS. 10 (A) to 10 (F) and an insulating sheet for a cover 97 shown in FIG. 10 (G.)

The coil unit 90 comprises sheet-like coils 91 and 92 singularly linked together and sheet-like coils 93 and 94 singularly linked together. Further, sheet-like coils 95 and 96 are singularly linked together.

Sheet-like coils 91, 92, 93, 94, 95 and 96 have the same structure as the sheet-like coil 20 and the like. Hence, explanation of details are omitted and only the different parts between sheet-like coils 91, 92, 93, 94, 95 and 96 and the sheet-like coil 20 will be explained.

Coils 91A, 92A, 93A, 94A, 95A and 96A correspond to the coil 22 and the like and have the same structure of the coil 22 and the like. Coil connecting portions 91S, 92S, 93S, 94S, 95S and 96S correspond to the coil connecting portion 22S and the like and have the same structure as the coil connecting portion 22S and the like. Further, through hole portions 91Sh, 92Sh, 93Sh, 94Sh, 95Sh and 96Sh correspond to the through hole portions 22Sh and the like and have the same structure as the through hole portions 22Sh and the like.

Further, electrode terminal portions 91B, 92B, 93B, 94B, 95B and 96B correspond to the electrode terminal portion 23 and the like and have the same structure as the electrode terminal portion 23 and the like. Further, through hole portions 91*h*, 92*h*, 93*h*, 94*h*, 95*h* and 96*h* correspond to the through hole portions 23*h* and the like and have the same structure as the through hole portions 23*h* and the like.

Sheet bodies 91C, 92C, 93C, 94C, 95C and 96C on which coils 91A, 92A, 93A, 94A, 95A and 96A are formed correspond to the sheet body 21 and the like and have the same structure as the sheet body 21. Further, the insulating sheet for a cover 97 corresponds to the insulating sheet for a cover 60 and has the same structure as the insulating sheet for a cover 60.

FIG. 9 is a plain view showing the coil unit 90 in which sheet-like coils 91, 92, 93, 94, 95 and 96, and the insulating sheet for a cover 97 are laminated.

The hole portion 90A corresponds to the hole portion 70A and the concave portion 90B corresponds to the concave portion 70B.

The coil 91A is connected to the coil 92A via the coil connecting portion 92S to be formed as a singularly linked coil. Further, the electrode terminal portion 91B placed on the top and left side and the electrode terminal portion 92B placed on the top and right side become electrode terminal portions for the coils 91A and 92A singularly linked together.

The coil 93A is connected to the coil 94A via the coil connecting portion 94S to be formed as a singularly linked coil. Further, the electrode terminal portion 93B placed on the left side which is a center along upper and lower directions and the electrode terminal portion 94B placed on the right side which is a center along upper and lower directions become electrode terminal portions for the coils 93A and 94A singularly linked together.

The coil 95A is connected to the coil 96A via the coil connecting portion 96S to be formed as a singularly linked coil. Further, the electrode terminal portion 95B placed on the lower and left side and the electrode terminal portion 96B placed on the lower and right side become electrode terminal portions for the coils 95A and 96A singularly linked together.

Further, in the coil unit 90 where sheet-like coils 91, 92, 93, 94, 95 and 96, and the insulating sheet for a cover 97 are laminated, the electrode terminal portions 96B placed on the top, left and right sides become electrode terminal portions for the coil 91A and the coil 92A singularly linked together and the electrode terminal portions 96B placed on the left and right sides which are a center along upper and lower directions become electrode terminal portions for the coil 93A and the coil 94A singularly linked together. Further, the electrode terminal portions 96B placed on the bottom, left and right sides become electrode terminal portions for the coil 95A and the coil 96A singularly linked together so that a three-circuits and six-terminals coil is formed.

(Second Modification)

The flexible coil 10 of the first embodiment described above has a structure in which the winding direction of the first coil is reversed from the winding direction of the second coil.

In other words, in case of that electrode terminal portions 53A and 53C are input terminals and electrode terminal portions 53B and 53D are output terminals, the winding direction of the first coil is reversed from the winding direction of the second coil.

Figure 11:
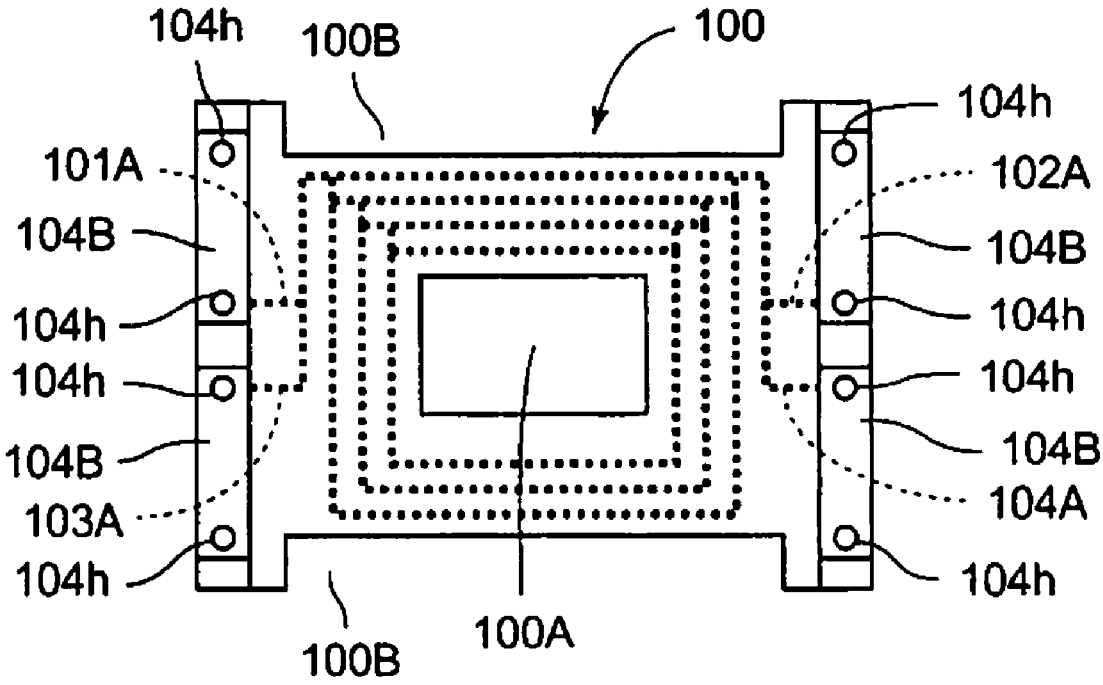
FIG. 11 is a plain view of a second modification of the coil unit included in the first embodiment of a flexible coil.
Figure 12:
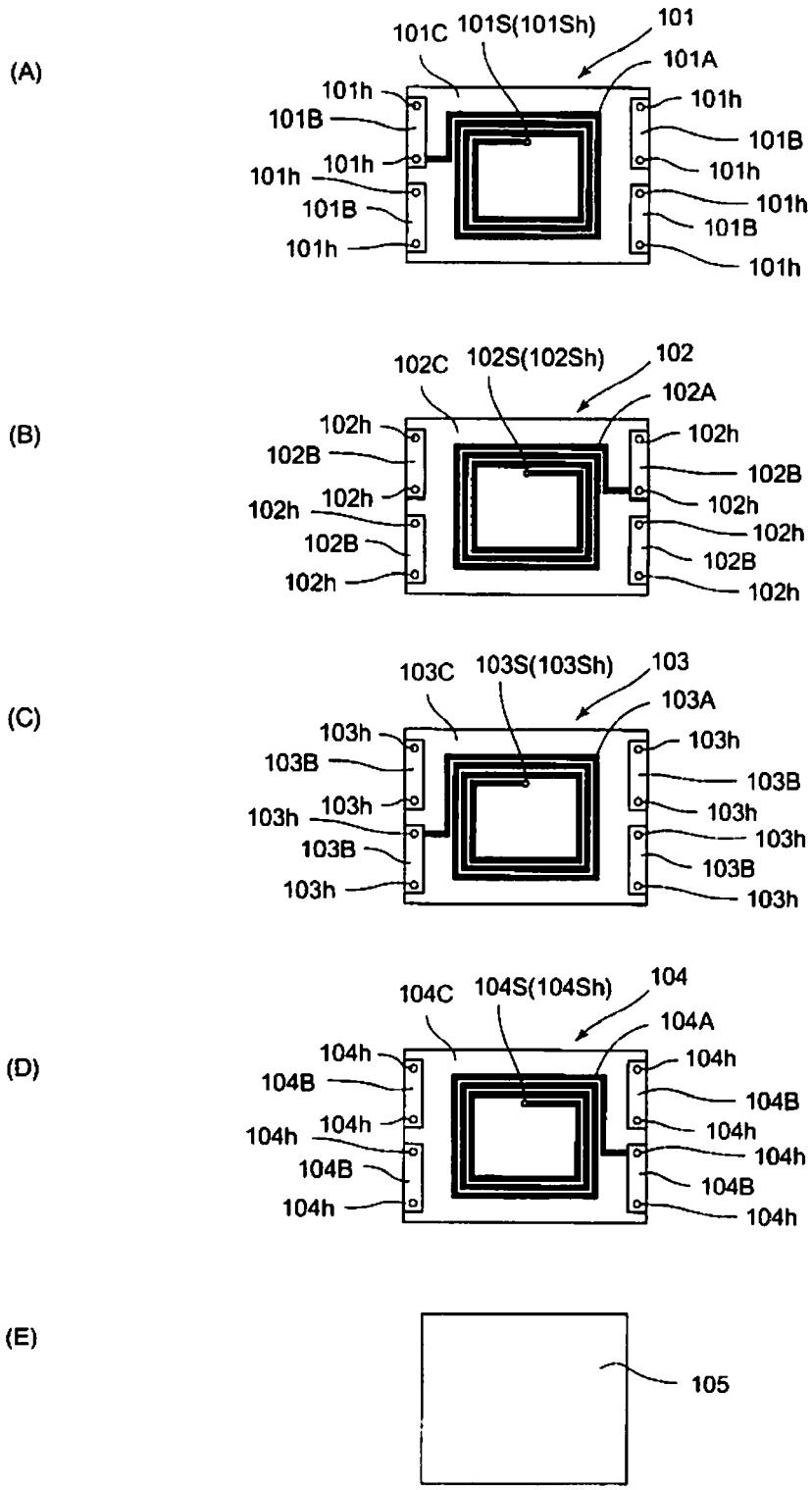
FIG. 12 is a broken-down view of a second modification of the coil unit included in the first embodiment of a flexible coil.

On the other hand, in a coil unit 100 shown in FIGS. 11 and 12, the winding direction of the first coil may be the same direction as the winding direction of the second coil.

The coil unit 100 comprises four sheet-like coils 101, 102, 103 and 104 shown in FIGS. 12 (A) to 12 (D) and the insulating sheet for a cover 105 shown in FIG. 12 (E).

The coil unit 100 comprises sheet-like coils 101 and 102 singularly linked together and sheet-like coils 103 and 104 singularly linked together.

Sheet-like coils 101, 102, 103 and 104 have the same structure as the sheet-like coil 20 and the like. Hence, explanation of details are omitted and only the corresponding parts between sheet-like coils 101, 102, 103 and 104 and the sheet-like coil 20 and the like will be explained.

Coils 101A, 102A, 103A and 104A correspond to the coil 22 and the like and have the same structure as the coil 22 and the like. Coil connecting portions 101S, 102S, 103S and 104S correspond to the coil connecting portion 22S and the like and have the same structure as the coil connecting portion 22S and the like. Further, through hole portions 101Sh, 102Sh, 103Sh and 104Sh correspond to the through hole portions 22Sh and the like and have the same structure as the through hole portions 22Sh and the like.

Further, in the coil unit 20, the winding directions of the coil 22 and the coil 32 are clockwise from the left side and the winding directions of the coil 42 and the coil 52 are counter clockwise from the left side. On the other hand, in the coil unit 100, the winding directions of the coils 101A and 102A and the coils 103A and 104A are clockwise from the left side.

Further, electrode terminal portions 101B, 102B, 103B and 104B correspond to the electrode terminal portion 23 and the like and have the same structure as the electrode terminal portion 23 and the like. Further, through hole portions 101*h*, 102*h*, 103*h* and 104*h* correspond to the through hole portions 23*h* and the like and have the same structure as the through hole portions 23*h* and the like.

Sheet bodies 101C, 102C, 103C and 104C on which coils 101A, 102A, 103A and 104A are formed correspond to the sheet body 21 and the like and have the same structure as the sheet body 21 and the like. Further, the insulating sheet for a cover 105 corresponds the insulating sheet for a cover 60 and has the same structure as the insulating sheet for a cover 60.

FIG. 11 is a plain view showing the coil unit 100 in which sheet-like coils 101, 102, 103 and 104 and the insulating sheet for a cover 105 are laminated.

The hole portion 100A corresponds to the hole portion 70A and the concave portion 100B corresponds to the concave portion 70B.

The coil 101A is connected to the coil 102A via the coil connecting portion 102S to be formed as a singularly linked coil. Further, the electrode terminal portion 101B placed on the top and left side and the electrode terminal portion 102B placed on the top and right side become electrode terminal portions for the coils 101A and 102A singularly linked together.

The coil 103A is connected to the coil 104A via the coil connecting portion 104S to be formed as a singularly linked coil. Further, the electrode terminal portion 103B placed on the lower and left side and the electrode terminal portion 104B placed on the lower and right side become electrode terminal portions for the coils 103A and 104A singularly inked together.

In the coil unit 100 in which sheet-like coils 101, 102, 103, 104 and the insulating sheet for a cover 105 are laminated, in case of that electrode terminal portions 104B placed on left, upper and lower sides are input terminals and electrode terminal portions 104B placed right, upper and lower sides are output terminals, the winding direction of the first coil in which the coils 101A and 102A are singularly linked together is the same winding direction as the second coil in which the coils 103A and 104A are singularly linked together.

The present invention is able to be applied to a flexible coil mounted on a flexible substrate.

The invention claimed is:

1. A flexible coil comprising :

a plurality of sheet-like coils laminated together in a region sharing a magnetic flux, wherein each sheet-like coil has a coil section formed along a surface of an insulating sheet having flexibility, wherein one or more holes are formed in center of the sheet-like coils, and one or more concave portions are formed on opposing side edge portions of the sheet-like coils; and a single flexible magnetic body formed by two flexible magnetic body's pieces which are sandwiching the plurality of the laminated sheet-like coils;

wherein:

a portion of each flexible magnetic body's piece is disposed in the sheet like coils hole to be entirely filled when sandwiched together to form the single flexible magnetic body;

one of the flexible magnetic body's pieces is equal in size to the outline of the sheet like coils and the other of the flexible magnetic body's pieces is smaller in size than the outline of the sheet like coils; and electrodes are exposed on both sides of the flexible magnetic body's piece that is smaller in size than the outline of the sheet like coils.

2. The flexible coil according to claim 1, wherein the sheet-like coil comprises a coil connecting portion installed in the inner periphery of the coil section and an electrode terminal portion installed in the outer periphery of the coil section, wherein the electrode terminal portion includes a terminal connecting portion that connects to the electrode terminal portion of the other sheet-like coil installed on a back side and wherein an end portion of the inner periphery of the coil section is connected to the coil connecting portion and an end of the outer periphery of the coil section is connected to the electrode terminal portion.

3. The flexible coil according to claim 2, wherein the coil connecting portion and the terminal connecting portion are through hole portions which form a conductive layer in each of the inner surface.

4. The flexible coil according to claim 1, wherein said coil section of one of said plurality of sheet-like coils is covered by the insulating sheet of another of said plurality of sheet-like coils when the sheet-like coil is installed or a plurality of the sheet-like coils are laminated.

5. The flexible coil according to claim 4,wherein the width of the other insulating sheet is smaller than the width of the sheet-like coil and the electrode terminal portion is exposed from both outsides of the other insulating sheet.

6. The flexible coil according to claim 2,wherein one sheet-like coil including the coil section of which a diameter becomes smaller from a clockwise direction or a counter clock wise direction is laminated with the other sheet-like coil including the coil section of which a diameter becomes lager from a clockwise direction or a counter clock wise direction.

7. The flexible coil according to claim 2,wherein one or more holes and one or more concave portions are formed in a center and both ends of the sheet-like coil and the magnetic body has a configuration which gets into the holes and the concave portions wherein one or more concave portions are formed at both ends of the sheet-like coil, and the magnetic bodies have a configuration which gets into the concave portions.

8. The flexible coil device according to claim 1, characterized in that the magnetic bodies are manufactured by mixing a resin with soft metal powders.

* * * * *